US006063754A

United States Patent [19]

Ness et al.

[11] Patent Number: 6,063,754

[45] **Date of Patent: *May 16, 2000**

[54] FABRIC CONDITIONING COMPOSITION

[75] Inventors: Jeremy Nicholas Ness, Canterbury; Keith Douglas Perring, Ashford, both of United Kingdom

[73] Assignee: Quest International B.V., Naarden, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 09/068,311

[22] PCT Filed: Nov. 4, 1996

[86] PCT No.: PCT/EP96/04802

§ 371 Date: Jul. 7, 1998

§ 102(e) Date: Jul. 7, 1998

[87] PCT Pub. No.: WO97/17419

PCT Pub. Date: May 15, 1997

[30] Foreign Application Priority Data

Nov. 7, 1995 [EP] European Pat. Off. ..... 95307951
Feb. 20, 1996 [EP] European Pat. Off. ..... 96301133

[51] Int. Cl.[7] ..... C11D 1/835; C11D 3/20

[52] U.S. Cl. ..... 510/526; 510/527

[58] Field of Search ..... 510/101, 504, 510/522, 526, 527

[56] References Cited

U.S. PATENT DOCUMENTS

| | | | |
|---|---|---|---|
| 4,137,180 | 1/1979 | Naik et al. | 252/8.8 |
| 4,559,150 | 12/1985 | Becker et al. | 252/8.6 |
| 4,965,000 | 10/1990 | Potts et al. | 252/8.75 |
| 5,447,644 | 9/1995 | Guenin et al. | 252/8.6 |
| 5,531,910 | 7/1996 | Severns et al. | 510/102 |
| 5,559,088 | 9/1996 | Severns et al. | 510/102 |

FOREIGN PATENT DOCUMENTS

| | | |
|---|---|---|
| 079 746 | 5/1983 | European Pat. Off. . |
| 2204608 | 11/1988 | United Kingdom . |
| 95 13346 | 5/1995 | WIPO . |

*Primary Examiner*—John R. Hardee
*Attorney, Agent, or Firm*—Pillsbury Madison & Sutro

[57] ABSTRACT

The invention concerns fabric conditioning compositions comprising at least 2 wt. % of a water insoluble cationic fabric softening agent and a perfume, characterized in that they further comprise a di- or tri-ester as set out under I, II and III: I. Diesters of monobasic acids and diols (a) where $R_1$, $R_2$ are independently $C_1$–$C_{10}$ alkyl chains or $C_2$–$C_{10}$ alkenyl chains, and $R_3$, $R_4$ are independently H, $C_1$–$C_4$ alkyl chains and n=0–8. II. Diesters of monohydric alcohols and dioic acids (b) where $R_1$, $R_2$ are independently $C_1$–$C_{18}$ alkyl chains or $C_2$–$C_{18}$ alkenyl chains, and $R_3$, $R_4$ are independently H, $C_1$–$C_4$ alkyl chain and n=0–10. III. Triesters of glycerol and aliphatic carboxylic acids of up to 12 carbon atoms. Preferably the cationic fabric softening agents comprise two C12–28 alkyl or alkenyl groups connected to a quaternary nitrogen via an ester link. The perfumes are preferably present in an amount of 0.1–4% w/w of the total composition and the di- and tri-esters are preferably present in an amount of at least 10% w/w of the perfume.

(a)

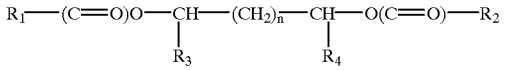

(b)

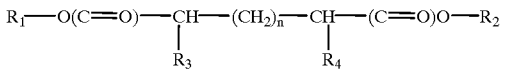

15 Claims, No Drawings

FABRIC CONDITIONING COMPOSITION

This application is the national phase of international application PCT/EP96/04802 filed Nov. 4, 1996 which designated the U.S.

The present invention relates to a fabric conditioning composition, particularly to aqueous fabric conditioning compositions comprising a dispersion of a water insoluble quaternary ammonium compound as the fabric softening agent and an aliphatic nonionic di- or tri-ester as a stabiliser, which compositions are rinse-added fabric softeners.

Rinse-added fabric conditioning compositions are well known. Typically such compositions contain a water insoluble quaternary ammonium fabric softening agent dispersed in water at a level of softening agent up to about 7 wt %, in which case the compositions are considered dilute, or at levels from 7 wt % to 50 wt %, in which case the compositions are known as concentrates.

U.S. Pat. No. 4,137,180 (Lever Brothers Company) discloses cationic di-esters of the formula below as fabric conditioning actives:

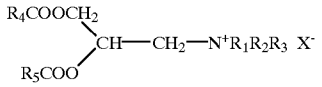

wherein $R_1$, $R_2$ and $R_3$ are each an alkyl or hydroxyalkyl group containing from 1 to 4 carbon atoms, or a benzyl group, $R_4$ and $R_5$ are each alkyl chains containing from 11 to 23 carbon atoms and $X^-$ is a water soluble anion.

One of the problems associated with many fabric conditioning compositions, including those containing cationic di-esters as disclosed in U.S. Pat. No. 4,137,180, is the physical instability of these compositions, which problem is aggravated at high and low temperatures and by the addition of perfume. When a fabric conditioner is in concentrated form the stability problem is further exacerbated and for this reason concentrated conditioners with high levels of perfume are rarely marketed. Even when the perfume is encapsulated in a solid matrix, stability problems can occur due to leakage of the capsules. The seriousness of the stability problem depends on the components in the perfume and thus may vary from perfume to perfume, but so far has been unpredictable.

In colder climates when a fabric conditioner is transported or stored in cold conditions a further problem often occurs in that the product gels to form a solid. Often these solids do not liquify any more at ambient temperatures or do so only very slowly (up to several days). This poses a problem to supermarkets who can not place the gelled product directly on their shelves.

EP 0 280 550 and EP 0 507 478 (Unilever) disclose the use of selected nonionic surfactants such as alkoxylated aliphatic alcohols to overcome the poor stability. However no mention is made of the instability problem caused by perfumes. In EP 0 042 562 a C12–C14 alcohol ethoxylated with 9 moles of ethylene oxide is used to improve stability.

In EP 0 013 780 and U.S. Pat. No. 4,426,299 (Procter & Gamble) the use of fatty acids, fatty acid esters, fatty alcohols and non-cyclic hydrocarbons for viscosity control of fabric conditioners is described. This enables the preparation of concentrated fabric conditioners. However, the instability caused by perfumes or temperature extremes are not mentioned and it has been found impossible to solve that problem with these compounds.

In U.S. Pat. No. 5,413,723 (IFF) again non-ionic surfactants are disclosed as stabilizers in fabric conditioners, but this does not present a substantially novel solution over EP 0 280 550 and EP 0 507 478 mentioned above. Furthermore in U.S. Pat. No. 5,447,644 a method is disclosed for perfuming fabric conditioners in which the perfume is first incorporated into a microemulsion with a surfactant (preferably non-ionic) with an HLB number of 12 or more. This patent also discloses a large number of well known fragrance materials suitable for use in perfumes for fabric conditioners.

In WO 95/22594 (Unilever) fabric conditioners are disclosed comprising a mix of a perfume and a carrier substance having a slip point below 45° C. As carrier substances are particularly preferred esters of fatty acids with mono- or poly-hydric alcohols having 1–24 carbon atoms in the hydrocarbon chain with the proviso that at least one of the hydrocarbon radicals in the ester has 12 or more carbon atoms.

None of the references cited above presents a satisfactory solution to the instability of fabric softener compositions caused by perfumes and temperature extremes. Therefore, there has only been a limited choice of perfumes which are suitable for such products, especially for the concentrated varieties.

It has now been found that stable concentrated fabric conditioning compositions with relatively high levels of perfume can be can be obtained which comprise at least 2% w/w of a water insoluble cationic fabric softening agent (hereinafter referred to as "active") and a perfume and which are characterized in that they further comprise a di- or tri-ester as set out below under I, II and III:

I. Diesters of Monobasic Acids and Diols

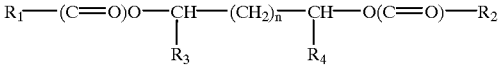

where $R_1$, $R_2$ are independently $C_1$–$C_{10}$ alkyl chains or $C_2$–$C_{10}$ alkenyl chains, and $R_3$, $R_4$ are independently H, $C_1$–$C_4$ alkyl chains and n=0–8.

II. Diesters of Monohydric Alcohols and Dioic Acids

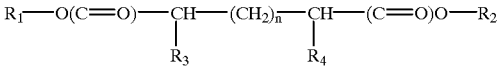

where $R_1$, $R_2$ are independently $C_1$–$C_{18}$ alkyl chains or $C_2$–$C_{18}$ alkenyl chains, and $R_3$, $R_4$ are independently H, $C_1$–$C_4$ alkyl chains and n=0–10. Preferably $R_1$, and $R_2$ have a maximum of 12, more preferably 10, carbon atoms. Also preferably n=0–8.

III. Triesters of Glycerol and Aliphatic Carboxylic Acids of up to 12 Carbon Atoms Preferably these aliphatic acids are saturated. More preferably the carboxylic acids have between 4 and 12 carbon atoms, even more preferably they have not more than 10, particularly not more than 8 carbon atoms.

The di- or tri-esters used in the invention as outlined above are hereinafter referred to as "stabilizers". Preferred stabilizers are substantially insoluble in water, particularly they are less than 0.01% w/w soluble in water.

The stabilizers according to the invention not only prevent instability caused by perfumes, but also aid in recovery of a fabric conditioner from a gelled state to a homogeneous liquid.

The active used in compositions according to the present invention preferably comprises a water insoluble cationic fabric softening agent of the class of biodegradable quaternary ammonium compounds with at least one ester link. Preferred compounds are fabric softening agents comprising two C12–28 alkyl or alkenyl groups connected to a quaternary nitrogen via an ester link.

Of particular interest with the present invention are softening compounds having the formula:

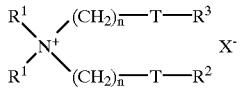

in which $R^1$ is a $C_1$–$C_4$ alkyl groups, $R^2$ and $R^3$ are the same or different $C_{12}$–$C_{22}$ alkyl or alkenyl groups, n=1–4 and the Ts are the same or different —(CO)—O— or —O—(CO)— or —O—(CO)—O— groups and $X^-$ is a water soluble anion.

Especially preferred are the quaternary ammonium compounds of the formula

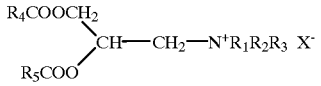

wherein $R_1$, $R_2$ and $R_3$ are each a C1–C4 alkyl or hydroxyalkyl group, or a C2–C4 alkenyl group, or a benzyl group, $R_4$ and $R_5$ are each C8–C28 alkyl chains and $X^-$ is a water soluble anion. Even more preferred is the active N-1,2-di (hardened tallowoyloxy)prop-3-yl N,N,N-trimethyl ammonium chloride Preferred materials and their method of preparation are described in U.S. Pat. No. 4,137,180 (Lever Brothers). Preferably these materials comprise small amounts of the corresponding mono-ester as described in U.S. Pat. No. 4,137,180 for example N-1-tallowoyl-2-hydroxyprop-3-yl N,N,N-trimethyl ammonium chloride.

The level of ester linked ammonium compound outlined above is 2% or more by weight of the composition; more preferably at least 5% by weight of the composition; most preferably 15–40% by weight of the composition.

The amount ratio of active to stabilizer is generally between 5:1 and 200:1, preferably between 10:1 and 100:1, more preferably between 10:1 and 60:1.

Perfumes are generally present in the fabric conditioning compositions according to the invention in an amount of 0.1–4% by weight, preferably 0.2–1%. It may be present as free perfume or incorporated in some carrier material, e.g. in encapsulated form. The ratio between the amount of active and the amount of perfume is generally between 5:1 and 150:1, preferably 10:1 to 50:1, even more preferably between 10:1 and 30:1.

The stabilizers may be used in combination with perfumes generally used in fabric softener compositions. However, they are particularly effective in combination with perfumes wherein:

(a) a maximum of 30% w/w of the total perfume is comprised of hydroxylic materials bearing at least one hydroxy group (specifically excluding salicylates), and possessing hydrophobicity such that the logarithm of the octanol/water partition coefficient falls between 2 and 5 units;

(b) the maximum amount of monofunctional saturated terpene alcohols, which are encompased by (a) is less than 0.5% w/w of the total perfume;

(c) a maximum of 4.0% w/w of the total perfume is comprised of materials containing an aldehyde group and possessing hydrophobicity such that the logarithm of the octanol/water partition coefficient falls between 2 and 5 units.

These preferred perfumes for stabilized fabric conditioning compositions preferably contain 5–30% by weight of materials of class (a+b), more preferably 10–28%, and preferably 0–3.5% of materials of class (c), more preferably 0.5–3.0%. The amount of stabilizer preferably is at least 10% by weight of the amount of perfume. The stabilizer according to the invention and the perfume may be combined into one composition before addition to the fabric conditioning composition.

These preferred perfumes also have a stabilizing effect on fabric conditioning compositions without the presence of the stabilizers of this invention. Therefore the invention also comprises fabric conditioning compositions as herein disclosed, but comprising these preferred perfumes instead of rather than in combination with the stabilizers referred to above. Finally the invention comprises preferred perfumes as herein above disclosed, which are suitable for incorporation in fabric conditioning compositions.

Fabric softener compositions according to the invention may also contain a zwitterionic material such as described in WO 95/13346 (Unilever), e.g. an alkyl amido-propyl dimethyl-amino acetic acid betaine of the formula:

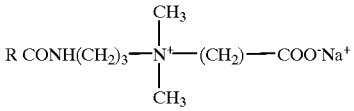

wherein R is a $C_{11-17}$ alkyl chain or mixtures thereof.

The level of zwitterionic material is preferably 0.1–8 wt % of the composition; more preferably 0.4–5 wt % of the total composition.

The composition may also contain long chain fatty acid materials for example $C_8$–$C_{24}$ alkyl or alkenyl monocarboxylic acids or polymers thereof. Preferably saturated fatty acids are used, in particular hardened tallow $C_{16}$–$C_{18}$ fatty acids. Preferably the fatty acid is non-saponified, more preferably the fatty acid is free, for example oleic acid, lauric acid or tallow fatty acid. The level of fatty acid is preferably at least 0.1% w/w, more preferably at least 0.2% by weight. Especially preferred are dilutes in which the fatty acid material is present from 0.25 wt % to 20 wt %. The weight ratio of quaternary ammonium compound to fatty acid material is preferably from 1:10 to 10:1.

The composition can also contain one or more other known ingredients, such as nonionic fabric softening agents (e.g. lanolin and derivatives thereof), non-aqueous solvents, viscosity control agents, pH buffering agents, inorganic salts, fluorescers, colorants, hydrotropes, antifoaming agents, antiredeposition agents, enzymes, optical brighteners, opacifiers, antishrinking agents, drape imparting agents, antistatic agents and ironing aids and concentrating agents.

It is also preferable if fatty alcohols or ethoxylated fatty alcohols are present in the composition. It is especially advantageous if they are present from 0.2 to 4% w/w of the total composition.

The fabric conditioning compositions according to the invention may be prepared according to methods known in the art, particularly as described in the references cited above. The stabilizer according to the invention and the perfume may be added in any convenient stage of the preparation, preferably after the cationic active and optionally the nonionic surfactant have been dispersed in the base material, which is conveniently done at an elevated temperature. The fabric conditioning composition may be formed from any base but it is especially preferred if the base is aqueous. The stabilizer may also be added to the fabric conditioning composition as part of the perfume.

The viscosities of these fabric conditioning compositions preferably lie in the range from 15 mPa.s to 120 mPa.s at a shear rate of $110s^{-1}$ and they preferably have a pH of 2 or more, more preferably between 2 and 5.

The invention will now be illustrated by the following non-limiting examples.

EXAMPLES A–M

Fabric conditioning compositions were prepared according to the general formulation outlined below:

| | % w/w |
|---|---|
| Cationic Active* | 14.0 |
| Non-ionic surfactant** | 1.20 |
| Calcium chloride | 0.20 |
| Stabilizer | 1.0 |
| Perfume | 0.75 |
| Water | to 100.0 |

*1,2 dihardened tallowyloxy trimethyl ammoniopropane chloride ex Hoescht
**Tallow alcohol 35EO The perfume was always according to the recipe given below. For each fabric conditioning composition a stabilizer was chosen from those mentioned below under A–I, mentioning stabilizer known from the prior art cited above and stabilizers according to the invention.

| Perfume Ingredient | wt % |
|---|---|
| APPLINAL (Q) | 2.0 |
| ALLYL AMYL GLYCOLATE | 1.0 |
| HELIONAL | 1.0 |
| STYRALLYL ACETATE | 1.0 |
| METHYL DIHYDROJASMONATE | 4.5 |
| β-PHENOXYETHYL ISOBUTYRATE, | 8.0 |
| JASMACYCLENE (Q) | 4.0 |
| GERANYL NITRILE | 1.0 |
| DIHYDROMYRCENOL | 4.5 |
| 3-METHYL-5-PHENYLPENTANOL | 12.0 |
| TETRAHYDROLINALOL | 12.0 |
| ALLYL-CYCLOHEXYL PROPIONATE | 1.0 |
| 3,5,5-TRIMETHYLHEXYL ACETATE | 5.0 |
| ORTHOLATE (Q) | 2.0 |
| p-TERT.BUTYL-CYCLOHEXYL ACETATE | 12.0 |
| CITRONELLYL ACETATE | 12.0 |
| DIHYDROMYRCENYL ACETATE | 14.0 |
| LIXETONE (Q) | 3.0 |

Q: Fragrance material supplied by Quest International

| Sample | 'Stabilizer' |
|---|---|
| A | None |
| B | White Mineral Oil |
| C | Mixture of C14–18 isoparaffins* |
| D | Dioctyl adipate |
| E | Stearic acid |
| F | Isopropyl myristate |
| G | Propylene glycol dicaprate/dicaprylate+ |
| H | Glycerol tricaprate/tricaprylate++ |

-continued

| Sample | 'Stabilizer' |
|---|---|
| I | Mixture of C9–12 isoparaffins+* |

*Isopar P ex Exxon
+Miglyol 840 ex Huls
++Miglyol 810 ex Huls
+*Isopar H ex Exxon The fabric conditioning compositions were prepared by premixing and heating the cationic active and the non-ionic surfactant to form a clear melt. This molten mixture was then added over a period of at least one minute to water at the same temperature with constant stirring to form a dispersion. This was then cooled to ambient temperature and perfume and any stabilizer added to the aqueous mixture separately.

The first set of non-limiting examples illustrates the relative performance of a number of possible stabilizers.

After preparation the samples of fabric conditioning compositions were stored at 370° C. and visually inspected for phase change and viscosity increase compared to unstored samples after two, four and six weeks. The results are presented in the following table, in which the descriptions denote the following:

OK—appearance and viscosity the same as unstored sample

Slight phase change—some evidence of phase change but still acceptable viscosity Failed—viscosity above acceptable range (>120 cps) and/or obvious phase change Gelled—sample substantially solid

| Sample | Two weeks | Four weeks | Six weeks |
|---|---|---|---|
| A | Gelled | Gelled | Gelled |
| B | Failed | Gelled | Gelled |
| C | Failed | Gelled | Gelled |
| D | OK | OK | OK |
| E | Gelled | Gelled | Gelled |
| F | Slight phase change | Failed | Failed |
| G | OK | OK | Slight phase change |
| H | OK | Slight phase change | Failed |
| I | Slight phase change | Failed | Failed |

Sample E gelled more rapidly than sample A

A second set of samples of fabric conditioning compositions were prepared as described above, however using a stabilizer as indicated under J–M below in an amount of only 0.5% w/w to illustrate the efficacy of stabilizers according to the prior art and according to the invention at particularly low levels of addition.

| Sample | Stabilizer | Level (wt %) |
|---|---|---|
| J | None | |
| K | C9–C12 isoparaffins | 0.5 |
| L | Isopropyl myristate | 0.5 |
| M | Dioctyl adipate | 0.5 |

After preparation the samples were stored at 370° C. and visually inspected for phase change and viscosity increase compared to unstored samples after two, four and six weeks.

The results are presented in the table below:

| Sample | Two weeks | Four weeks | Six weeks |
|---|---|---|---|
| J | Gelled | Gelled | Gelled |
| K | Failed | Gelled | Gelled |
| L | Failed | Failed | Gelled |
| M | OK | OK | Slight phase change |

EXAMPLE N

Fabric conditioning composition was prepared according to the formulation outlined below:

| | % w/w |
|---|---|
| Cationic Active* | 14.0 |
| Non-ionic surfactant** | 1.20 |
| Calcium chloride | 0.20 |
| Perfume | 0.75 |
| Water | to 100.0 |

*1,2 dihardened tallowyloxy trimethyl ammoniopropane chloride ex Hoescht
**Tallow alcohol 35EO The perfume/stabilizer mixture was according to the recipe given below.

| Perfume Ingredient | wt % |
|---|---|
| Aldehyde iso-C11 10% DPG | 1.00 |
| Allyl-cyclohexyl propionate | 1.20 |
| Amyl salicylate (Q) | 2.50 |
| Bangalol (Q) | 1.00 |
| Benzyl salicylate (Q) | 6.30 |
| Citronellol pure | 5.00 |
| Coumarin | 2.00 |
| Damascenone (F) 10% DPG | 0.50 |
| Decen-1-ol | 0.20 |
| Dihydromyrcenol (Q) | 5.00 |
| Dimethyl-benzyl-carbinyl acetate | 1.20 |
| Diphenyl oxide | 0.50 |
| Florocyclene (Q) | 2.00 |
| Galaxolide IPM (I) | 12.00 |
| Geranium Bourbon pure | 0.50 |
| Hexylcinnamic aldehyde | 12.00 |
| Jasmacyclene (Q) | 2.00 |
| Jasmopyrane Forte (Q) | 2.00 |
| Lavandin Abrialis | 1.00 |
| Linalol | 4.00 |
| Methyl dihydrojasmonate Super (Q) | 3.50 |
| Methyl Ionone Alpha Iso (Q) | 7.50 |
| p-Tertbutyl-cyclohexyl acetate (Q) | 6.50 |
| Patchouli acid-washed (Q) | 3.00 |
| Rosacetone | 0.50 |
| Styrallyl acetate | 0.50 |
| Tonalid 2 (P) | 5.00 |
| Undecalactone gamma | 0.60 |
| Ylang extract | 1.00 |
| Total | 90.00 |

To this perfume mixture was added dihexyl, dioctyl or dinonyl adipate in amounts of 10, 20 and or 30% by weight.
Q: Fragrance material supplied by Quest International
I: Fragrance material supplied by IFF
P: Fragrance material supplied by PFW The fabric conditioning composition was prepared by premixing and heating the cationic active and the non-ionic surfactant to form a clear melt. This molten mixture was then added over a period of at least one minute to water at the same temperature with constant stirring to form a dispersion. This was then cooled to ambient temperature and perfume/stabilizer mixture added to the aqueous mixture separately.

What is claimed is:

1. In a liquid aqueous fabric conditioning composition comprising at least 2 wt % of a water insoluble cationic fabric softening agent which is a quaternary ammonium compound with at least one ester link and a perfume, the improvement which comprises including in said composition, as a stabilizer for said composition, an effective amount of the diester dioctyl adipate.

2. Fabric conditioning compositions according to claim 1 characterized in that they comprise a cationic fabric softening agent comprising two C12–28 alkyl or alkenyl groups connected to a quaternary nitrogen via an ester link.

3. Fabric conditioning compositions according to claim 2 characterized in that the cationic fabric softening agent is a compound having the formula:

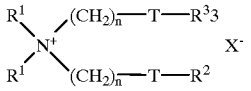

in which $R^1$ is a $C_1$–$C_4$ alkyl groups, $R^2$ and $R^3$ are the same or different $C_{12}$–$C_{22}$ alkyl or alkenyl groups, n=1–4 and the Ts are the same or different —(CO)—O— or —O—(CO)— or —O—(CO)—O— groups and $X^-$ is a water soluble anion.

4. Fabric conditioning compositions according to claim 2 characterized in that the cationic fabric softening agent is a compound having the formula:

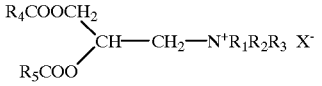

wherein $R_1$, $R_2$ and $R_3$ are each a C1–C4 alkyl or hydroxyalkyl group, or a C2–C4 alkenyl group, or a benzyl group, $R_4$ and $R_5$ are each C8–C28 alkyl chains and $X^-$ is a water soluble anion.

5. Fabric conditioning compositions according to claim 1 characterized in the ratio between the amount of cationic fabric softening agent and the amount of diester is between 5:1 and 200:1.

6. Fabric conditioning compositions according to claim 5 characterized in that the ratio between the amount of cationic fabric softening agent and the amount of diester is between 10:1 and 100:1.

7. Fabric conditioning compositions according to claim 1 characterized in that they contain 0.1–4% w/w of perfume.

8. Fabric conditioning compositions according to claim 7 characterized in that they contain 0.2–1% w/w of perfume.

9. Fabric conditioning compositions according to claim 1 characterized in that the ratio between the amount of cationic fabric softening agent and the amount of perfume is between 5:1 and 150:1.

10. Fabric conditioning compositions according to claim 1 characterized in that they comprise a perfume wherein:

(a) a maximum of 30% w/w of the total perfume is comprised of hydroxylic materials bearing at least one hydroxy group (specifically excluding salicylates), and possessing hydrophobicity such that the logarithm of the octanol/water partition coefficient falls between 2 and 5 units;

(b) the maximum amount of monofunctional saturated terpene alcohols, which are encompased by (a) is less than 0.5% w/w of the total perfume;

(c) a maximum of 4.0% w/w of the total perfume is comprised of materials containing an aldehyde group and possessing hydrophobicity such that the logarithm of the octanol/water partition coefficient falls between 2 and 5 units.

11. Fabric conditioning compositions according to claim 10 characterized in that the perfume contains 5–30% by weight of materials of class (a+b) and 0–3.5% by weight of materials of class (c).

12. Fabric conditioning compositions according to claim 11 characterized in that the perfume contains 10–28% by weight of materials of class (a+b) and 0.5–3.0% by weight of materials of class (c).

13. Fabric conditioning compositions according to claim 10 characterized in that the amount of di-ester is at least 10% by weight of the amount of perfume.

14. Fabric conditioning compositions according to claim 1 characterized in that they also comprise a nonionic surfactant and/or a zwitterionic material.

15. A method of conditioning fabrics comprising adding a composition according to claim 1 to a rinse step for said fabrics.

* * * * *